US005855100A

United States Patent [19]

Hsueh

[11] Patent Number: 5,855,100

[45] Date of Patent: Jan. 5, 1999

[54] PARTITION WALL

[76] Inventor: Yi-Cheng Hsueh, No. 20, Lane 195, Yung Fong Road, Tu Cheng, Taipei Hsien, Taiwan

[21] Appl. No.: 97,095

[22] Filed: Jun. 12, 1998

[51] Int. Cl.[6] ..... E04C 2/34

[52] U.S. Cl. ..... 52/481.2; 52/489.1; 52/511; 52/586.1; 52/656.1

[58] Field of Search ..... 52/481.2, 239, 52/489.1, 586.1, 586.2, 656.1, 511

[56] References Cited

U.S. PATENT DOCUMENTS

| | | | |
|---|---|---|---|
| 3,378,977 | 4/1968 | Vervloet | 52/481.2 |
| 3,623,290 | 11/1971 | Downing, Jr. | 52/481.2 |
| 3,705,471 | 12/1972 | Allen | 52/489.1 X |
| 3,731,447 | 5/1973 | Dawdy et al. | 52/489.1 X |
| 5,537,795 | 7/1996 | Dias | 52/586.2 |

*Primary Examiner*—Christopher Kent
*Attorney, Agent, or Firm*—Kenneth Q. Lao

[57] ABSTRACT

A partition wall including a frame assembly and partition boards fastened to front and rear sides of the frame assembly by coupling spring plates, wherein the frame assembly includes two stiles of aluminum alloy profiles, each stile having two parallel channel bars and a longitudinal frame board connected between the channel bars, two rigid transverse rails connected between the stiles at top and bottom sides, each transverse rail having two angled end-pieces respectively engaged into respective longitudinal locating grooves defined between the first channel bars and the second channel bars of the stiles, and two rigid coupling bars respectively fastened to the stiles at an outer side for enabling two partition walls to be abutted against each other.

5 Claims, 3 Drawing Sheets

PARTITION WALL

BACKGROUND OF THE INVENTION

The present invention is related to a partition wall, and more particularly to a built-up partition wall that can be conveniently set up at a job site.

Conventionally, nails, screws, bolts, etc., are commonly used to fasten partition boards to a frame structure when making a partition wall in a room. The conventional partition wall has numerous drawbacks:

1. The construction procedure is complicated and special tools must be used and only well-trained professional workers can do the job.
2. It has poor dust proof and sound proof
3. The partition wall tends to vibrate, causing its parts to fall out of place after construction, and
4. The partition wall is monotonous and unattractive.

It is advantageous to provide a partition wall which is easy to put together and provides better sound proof.

SUMMARY OF THE INVENTION

The present invention provides a partition wall which eliminates the aforesaid drawbacks. According to the present invention, a partition wall can be conveniently and quickly set up by the user without the use of tools. The partition wall in accordance with the present invention can be formed of a single partition wall unit, or a plurality of partition wall units fastened together. Each partition wall unit consists of a frame assembly, and a plurality of partition boards fastened to the front and rear sides of the frame assembly by coupling spring plates. The frame assembly includes two stiles of aluminum alloy profiles, each stile having two parallel channel bars and a longitudinal frame board connected between the channel bars, two rigid transverse rails connected between the stiles at top and bottom sides, each transverse rail having two angled end-pieces respectively engaged into respective longitudinal locating grooves defined between the first channel bars and the second channel bars of the stiles, and two rigid coupling bars respectively fastened to the stiles at an outer side for enabling two partition walls to be abutted against each other.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
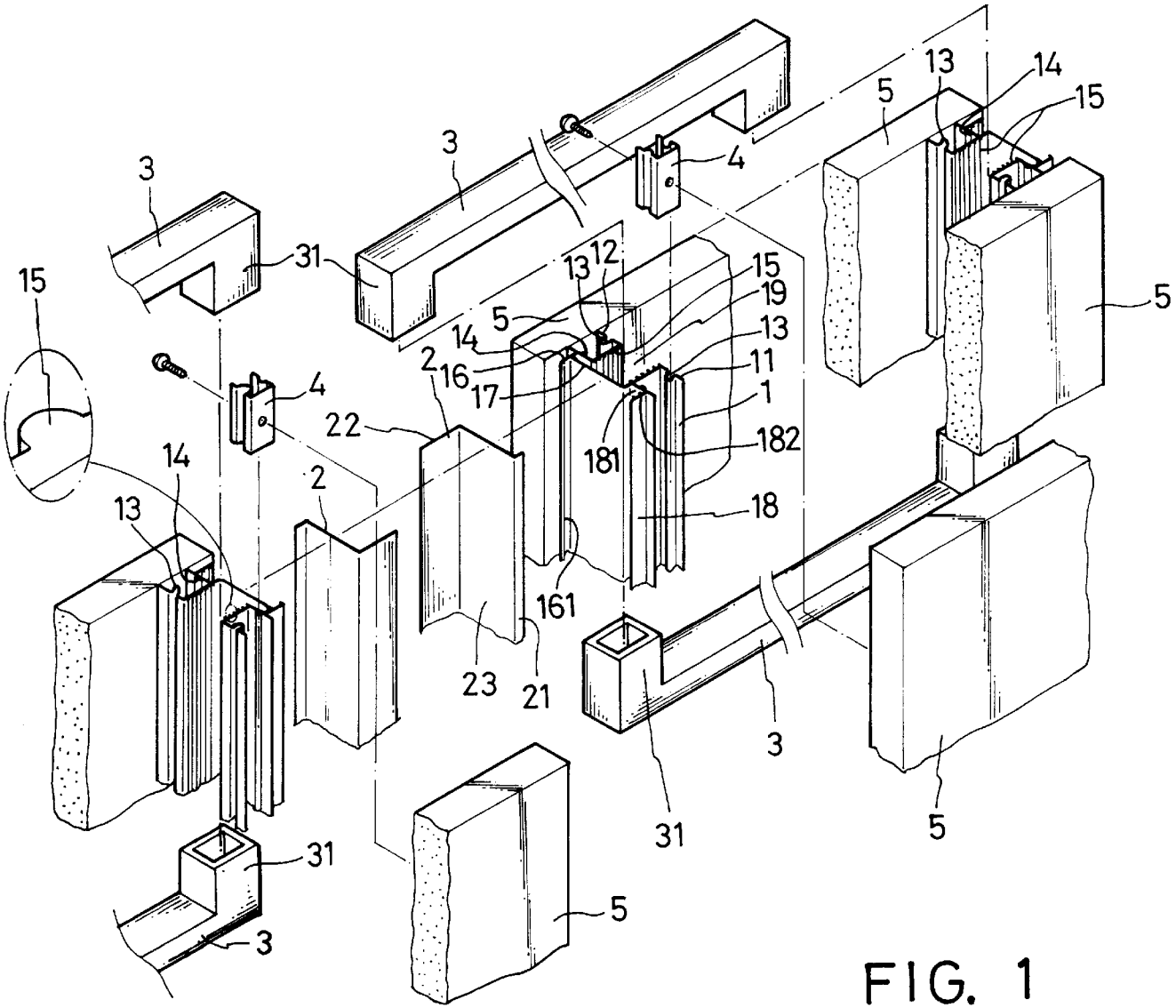
FIG. 1 is an exploded view of a frame assembly according to the present invention.

Referring to FIGS. from 1 to 3, a partition wall in accordance with the present invention is comprised of an at least one frame assembly, and a plurality of partition boards 5 fastened to the at least one frame assembly at front and back sides. A frame assembly for a partition wall in accordance with the present invention is generally comprised of two stiles 1 arranged in parallel, two longitudinal coupling bars 2 each fastened to one stile 1 at an outer side, and two transverse rails 3 respectively connected between the stiles 1 at top and bottom sides.

The stiles 1 are of aluminum alloy profiles, each comprising a first channel bar 11, a second channel bar 12, a longitudinal frame board 17 connected between the first channel bar 11 and the second channel bar 12, a first longitudinal rail 18 raised from the first channel bar 11 at an outer side and defining with the longitudinal frame board 17 a longitudinal coupling groove 181 at an outer side, a plurality of raised portions 182 provided inside the longitudinal coupling groove 181, a second longitudinal rail 16 raised from the connecting area between the second channel bar 12 and the longitudinal frame board 17. The second longitudinal rail 16 has a plurality of raised portions 161. The channel bars 11,12 each comprise a longitudinal retaining rib 13 and a longitudinal retaining groove 14 bilaterally disposed on the inside to which clamps 4 are fastened, and a plurality of raised portions 15 near top and bottom ends thereof The longitudinal coupling bars 2 have a Z-shaped cross section, each comprising a rectangular flat base 23 closely attached to the longitudinal frame board 17 at an outer side, a narrow coupling flange 21 raised along one long side of the flat base 23 and inserted into the longitudinal coupling groove 181 on the first longitudinal rail 18 of one stile 1, a wide coupling flange 22 raised along the other long side of the rectangular flat base 23 for fastening to the longitudinal coupling groove 181 on the first longitudinal rail 18 of another frame assembly. When two frame assemblies are fastened together side by side, the narrow coupling flange 21 of the longitudinal coupling bar 2 at one side of the first frame assembly and the wide coupling flange 22 of the longitudinal coupling bar 2 at one side of the second frame assembly are fastened to the longitudinal coupling groove 181 on the first longitudinal rail 18 at one side of the first frame assembly, the wide coupling flange 22 of the longitudinal coupling bar 2 at one side of the first frame assembly and the narrow coupling flange 21 of the longitudinal coupling bar 2 at one side of the second frame assembly are fastened to the longitudinal coupling groove 181 on the first longitudinal rail 18 of the second frame assembly. When the matched longitudinal coupling bars 2 of two frame assemblies are fastened together, the raised portions 182,161 are squeezed, and therefore a reactive force is produced and imparted to the matched narrow coupling flange 21 and wide coupling flange 22, causing the matched narrow coupling flange 21 and wide coupling flange 22 to be firmly secured together.

The transverse rails 3 are made of U-shaped square tubing, each rail comprising two end-pieces 31 respectively tightly inserted into the longitudinal locating grooves 19 defined between the first channel bars 11 and the second channel bars 12. When the end-pieces 31 of the transverse rails 3 are respectively inserted into the longitudinal locating grooves 19, the raised portions 15 are squeezed, and therefore a reactive force is produced and imparted to the end-pieces 31 of the transverse rails 3, causing the transverse rails 3 to be firmly retained between the stiles 1.

Figure 2:
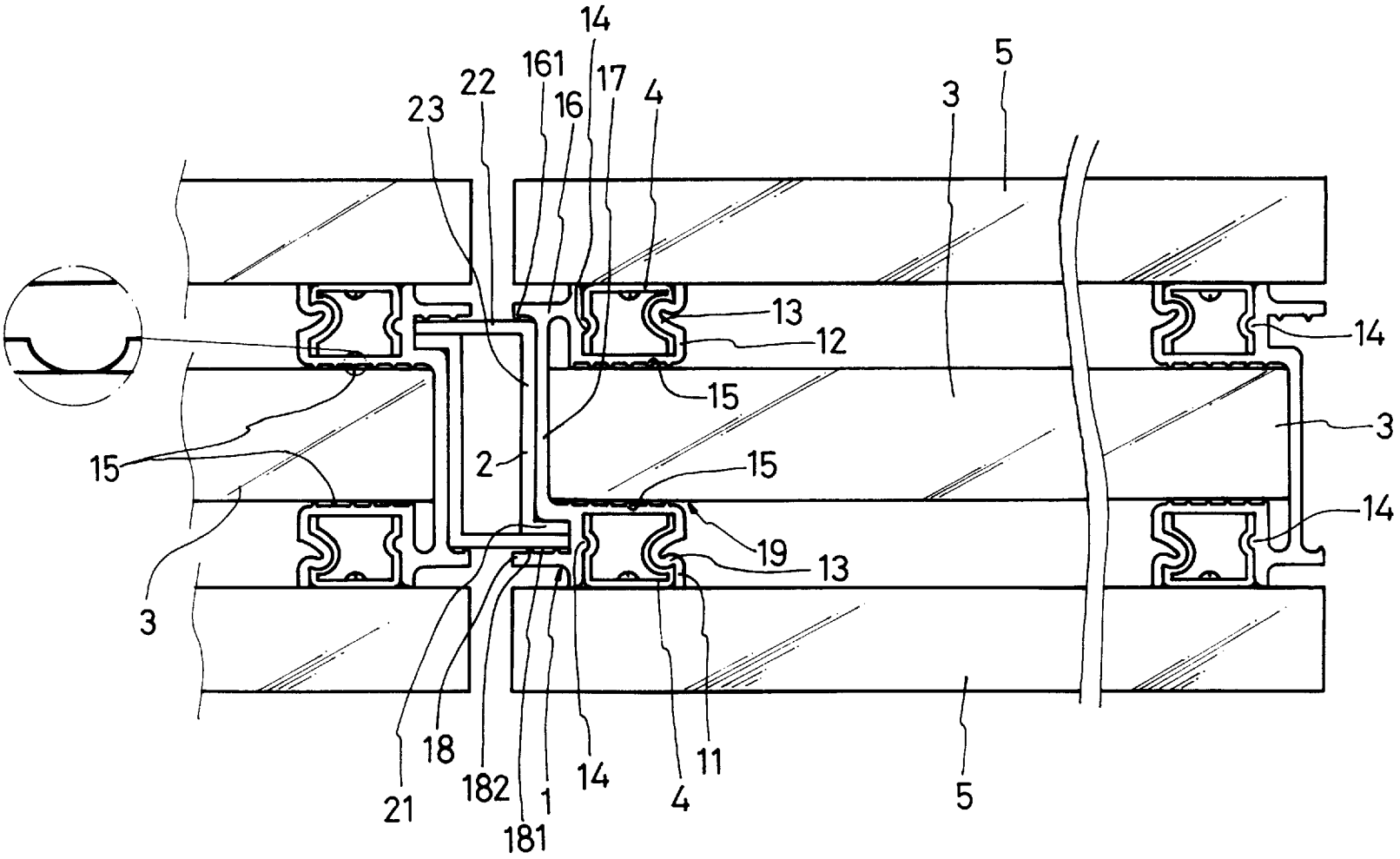
FIG. 2 is a top plain view showing two unit partition walls connected together.
Figure 3:
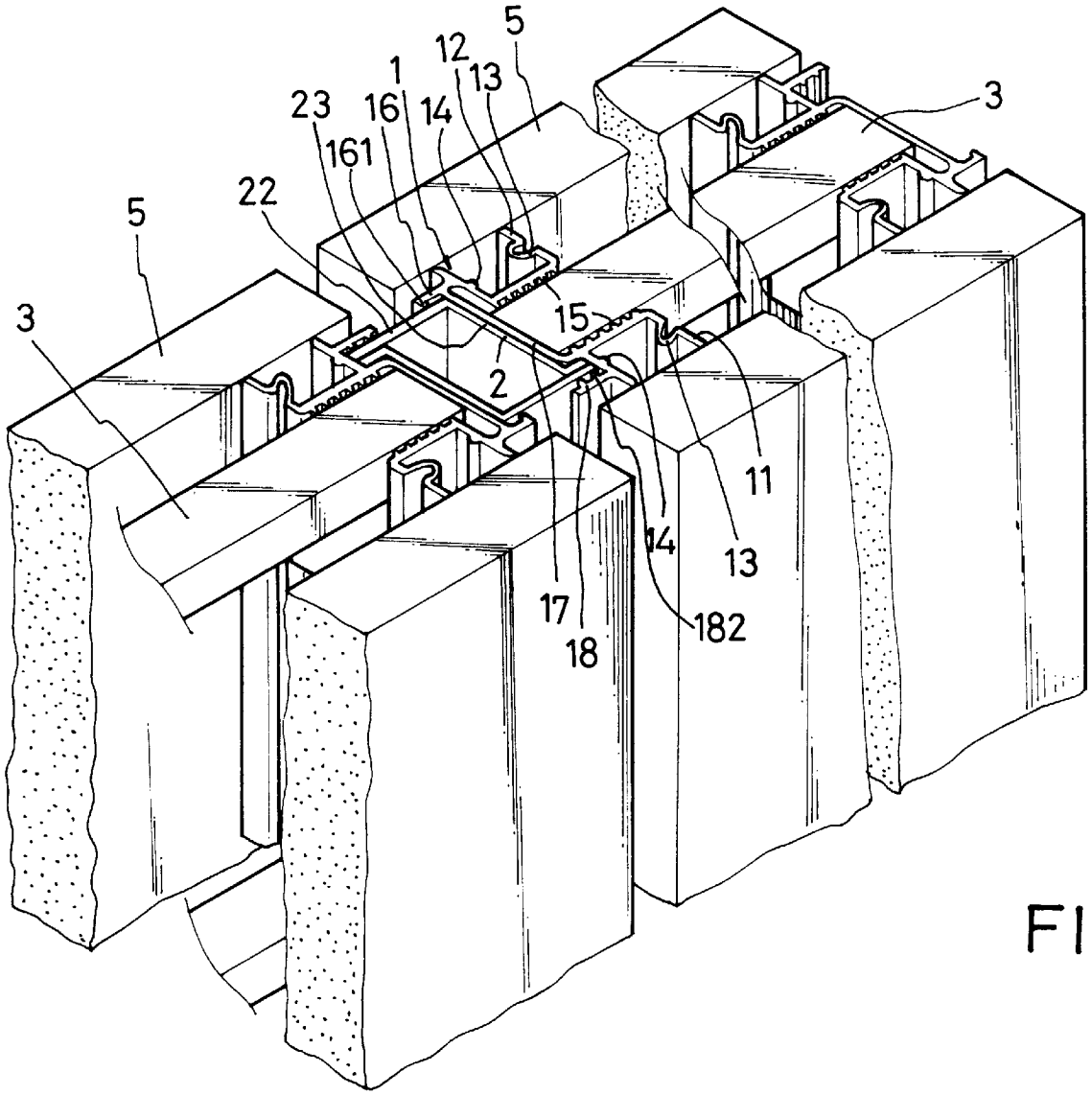
FIG. 3 is a perspective view of FIG. 2.

Referring to FIGS. 1 and 2 again, when the stiles 1 are erected from the floor, the rails 3 are fastened to the longitudinal locating grooves 19 between the stiles 1, and then the coupling bars 2 are fastened to one stile 1. When the frame assembly is set up, partition boards 5 are fastened to the first channel bars 11 and second channel bars 12 of the stiles 1 by coupling spring plates 4, and therefore a partition wall is built up. The front side panel and the rear side panel of the partition wall may be respectively formed of a single piece of partition board 5. Alternatively, the several partition boards of relatively smaller size may be arranged into a front side panel or rear side panel for the partition wall. The coupling spring plates 4 are fixedly fastened to the partition boards 5, and then forced into engagement with the longitudinal retaining ribs 13 and longitudinal retaining grooves 14 of the channel bars 11,12.

According to the present invention, the stiles 1 are molded from aluminum alloy, the coupling bars 2 and the rails 3 are made of rigid metal or example steel. When the coupling bars 2 and the rails 3 are fastened to the stiles 1, the raised portions 15,161,182 are squeezed and slightly deformed, enabling the coupling bars 2 and the rails 3 to be firmly retained to the stiles 1. The raised portions 15,161,182 preferably have a rounded outside wall curved outwards. Further, by means of the coupling bars 2, two frame assemblies can be fastened together.

While only one embodiment of the present invention has been shown and described, it will be understood that various modifications and changes could be made thereunto without departing from the spirit and scope of the invention disclosed.

What is claimed is:

1. A partition wall comprising a frame assembly, and a plurality of partition boards fastened to front and rear sides of said frame assembly, said partition boards being fixedly mounted with coupling spring plates for fastening to said frame assembly, wherein said frame assembly comprises:

two parallel stiles of aluminum alloy profiles, said stiles each comprising a first channel bar, a second channel bar, a longitudinal frame board connected between said first channel bar and said second channel bar, a first longitudinal rail raised from said first channel bar at an outer side and defining with said longitudinal frame board a longitudinal coupling groove at an outer side, a plurality of raised portions provided inside said longitudinal coupling groove, a second longitudinal rail raised from the connecting area between said second channel bar and said longitudinal frame board, said second longitudinal rail having a plurality of raised portions, said first and second channel bars defining a longitudinal locating groove;

two transverse rails connected between said stiles at top and bottom sides, said transverse rails being made of rigid tube each comprising two end-pieces respectively tightly inserted into the longitudinal locating grooves defined between the first channel bars and the second channel bars of said stiles; and two longitudinal rigid coupling bars respectively fastened to the stiles at an outer side, said coupling bars having a Z-shaped cross section, each comprising a rectangular flat base closely attached to the longitudinal frame board of one stile at an outer side, a narrow coupling flange raised along one long side of said flat base and inserted into the longitudinal coupling groove on the first longitudinal rail of one stile, a wide coupling flange raised along an opposite long side of said rectangular flat base for fastening to the longitudinal coupling groove on the first longitudinal rail of another frame assembly.

2. The partition wall of claim 1 wherein the first channel bar and second channel bar of each of said stiles each comprise a longitudinal retaining rib and a longitudinal retaining groove bilaterally disposed on the inside for engagement with the coupling spring plates of said partition boards.

3. The partition wall of claim 1 wherein said first and second channel bars of each of said stiles each comprise a plurality of raised portions near top and bottom ends that are squeezed by the end-pieces of said transverse rails when the end-pieces of said transverse rails are respectively inserted into the longitudinal locating grooves defined between the first channel bars and the second channel bars of said stiles.

4. The partition wall of claim 1 wherein the raised portions of said second longitudinal rail each have a rounded outside wall curved outwards.

5. The partition wall of claim 3 wherein the raised portions of said first and second channel bars each have a rounded outside wall curved outwards.

* * * * *